United States Patent [19]

Linnemann et al.

[11] Patent Number: 4,819,925

[45] Date of Patent: Apr. 11, 1989

[54] DECONTAMINATION TABLE

[75] Inventors: Roger Linnemann, Wallingford; Thomas E. Linnemann, Holland, both of Pa.; Mary E. Berger, Port St. Lucie, Fla.; Wayne G. Richardson, Ardmore, Pa.

[73] Assignee: Radiation Management Consultants, Inc., Philadelphia, Pa.

[21] Appl. No.: 69,499

[22] Filed: Jul. 2, 1987

[51] Int. Cl.[4] ..... A61G 13/00

[52] U.S. Cl. ..... 269/327; 269/322; 269/323

[58] Field of Search ..... 269/322–327, 269/328; 5/82 R, 81 R, 468; 108/24; 604/322

[56] References Cited

U.S. PATENT DOCUMENTS

| | | | |
|---|---|---|---|
| 2,569,561 | 10/1951 | Friedman | 108/24 |
| 2,576,116 | 11/1951 | Hoffman | 269/323 |
| 3,167,789 | 2/1965 | Wicks | 5/81 R |
| 3,813,712 | 6/1974 | Bonnin | 5/82 |
| 3,947,686 | 3/1976 | Cooper et al. | 269/322 |
| 4,067,079 | 1/1978 | Buchman | 5/82 R |
| 4,082,257 | 4/1978 | Strickland | 269/328 |
| 4,650,171 | 3/1987 | Howorth | 269/322 |

*Primary Examiner*—Frederick R. Schmidt

*Assistant Examiner*—Judy J. Hartman

*Attorney, Agent, or Firm*—Eugene E. Renz, Jr.

[57] ABSTRACT

A decontamination wash down device for use in conjunction with a gurney, including a backboard and a decontamination table. The backboard has a generally rectangular shape and size to provide a patient support area. The backboard includes a plurality of spaced apart slots through its thickness to permit fluid flow off of said patient to the underside. The underside includes a plurality of ribs extending a predetermined distance to prevent movement of the backboard in the basin and raise the backboard above the surface on which it is placed. The table has a generally rectangular shape and includes a basin sized to receive the backboard. The basin includes a drain for removal of fluids. The table has a raised lip portion around the periphery of the table and a ledge portion extending inward from said lip toward the backboard to provide an enlarged patient support area. The basin has a plurality of rails facing the underside of the backboard which are located to cooperatively position the backboard with the plurality of ribs to prevent movement of the backboard in the basin. The table further has a plurality of runners on the underside which are positioned to support the table on a gurney. The table also has a lock on the underside for attaching it to a gurney.

12 Claims, 3 Drawing Sheets

DECONTAMINATION TABLE

FIELD OF THE INVENTION

This invention relates to a decontamination table device which facilitates the delivery of emergency medical treatment to a contaminated patient while providing for the removal and collection of the contaminants.

BACKGROUND OF THE INVENTION

Injuries or illnesses complicated by the presence of radiological, chemical or biological contaminants present a unique problem to the medical community. Immediate medical care must be delivered to a contaminated accident victim. It is also imperative that these contaminants be contained and disposed of properly in order to minimize potential hazards to victims, attendants and to the medical care facility. It is necessary to deliver emergency medical treatment while providing a method for removing and collecting the contaminants.

Prior art methods for facilitating medical treatment, decontamination and containment of the contaminants from an injured contaminated victim have not been effective. Particularly when the victim is not ambulatory and has extensive contamination, there has not yet been an effective procedure developed to rapidly treat and decontaminate the victim without excess movement of the victim and/or spreading the contaminants.

Prior methods for decontaminating contaminated patients require that the patient be placed in a decontamination unit with concave supports and the like. The decontamination units have been ineffective in totally removing all contamination from the patient, and were unable to provide an enlarged patient support area for use during medical treatment. No device has yet been made available which can be used in combination with standard and readily available hospital gurneys and stretchers.

It would be of great advantage to the medical community if a decontamination table could be provided which would facilitate rapid emergency medical care and would permit the removal of toxic chemicals, radioactive materials or biological agents and organisms from non-ambulatory patients. In addition, such a table would be extremely useful in treating burn injuries and in cooling victims of hypothermia. Such a decontamination table would also be very suitable for use by morticians and medical personnel performing autopsies.

SUMMARY OF THE INVENTION

It has now been discovered that the objects of the present invention can be accomplished in the following manner. Specifically, a highly effective self-contained and comprehensive decontamination table is now available for use with a gurney for the treatment of non-ambulatory patients who have been contaminated with radiological, chemical or biological contaminants. Immediate care is effected and the contaminants may be disposed of to minimize or eliminate potential hazard to the victim, attendants and the facility itself.

Specifically, the invention comprises a decontamination table device which is admirably suited for use with standard hospital gurneys. The device comprises a backboard and an associated table which may be easily and conveniently attached to an ordinary gurney or stretcher. The backboard has a generally rectangular shape and is sized to provide a patient support area, so that the patient can be placed on the backboard. The backboard includes a plurality of slots which are arranged in a predetermined pattern and which include slots on the periphery which are used by attendants to provide a safe and sure hand gripping area. The backboard also includes a plurality of ribs extending along the bottom or underside of the backboard to raise the backboard above the surface on which it is placed. In combination with the backboard is a table which has a generally rectangular shape and includes a basin which is sized to receive the backboard. The basin includes a drain for removal of fluids which pass through the slots on the backboard and which pass between the periphery of the backboard and the sides of the table. The table has a raised lip portion around its periphery and a ledge portion extending inward from the lip towards the backboard in order to provide an extended or enlarged patient support area. The ledge and basin are sized so as to permit a space or gap between the ledge and the periphery of the backboard once it is placed in its intended position on the basin, again, so that fluid can flow down to the basin. The basin also includes a plurality of rails facing the underside of the backboard and located to cooperate with the ribs located on the underside of the backboard to thereby position the backboard in the basin and prevent movement of the backboard with respect to the basin. The table further includes a plurality of runners on the underside of the table which are positioned to support the table on a gurney. The table has locking means on the underside of the table for attaching the table to the gurney.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
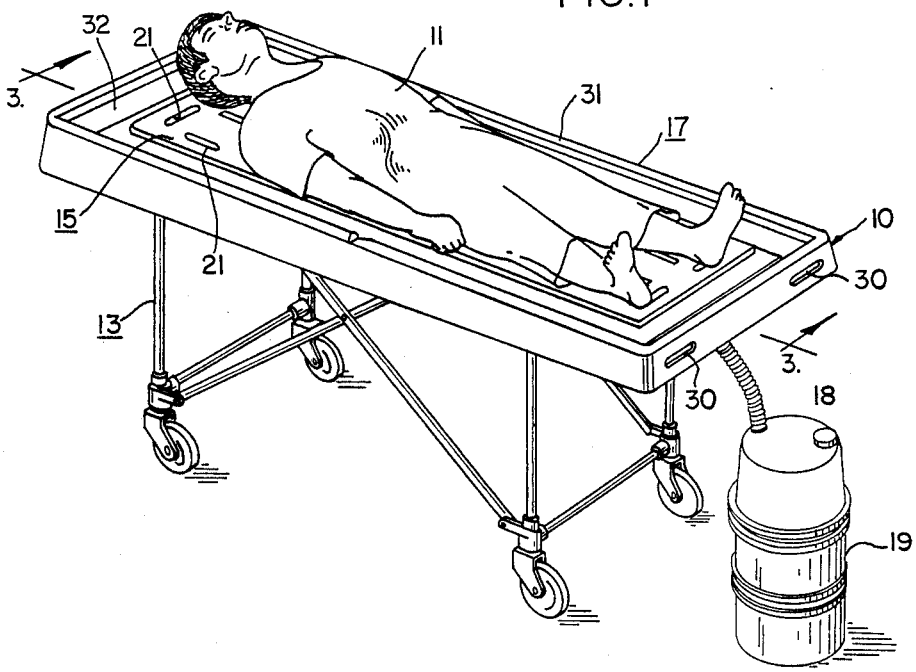
FIG. 1 is a perspective view, illustrating one use of the decontamination table of this invention, shown mounted on a hospital gurney.

The decontamination table device is shown generally by the reference numberal 10 in FIG. 1, in which a patient 11 is to be treated while the patient is lying on the backboard 15. The hospital gurney 13 supports a table 17 in which is placed a backboard 15 so that the patient may be treated and the contaminants may be collected. An accordion pleated hose 18 is connected to the decontamination waste container 19, which is a sealed container suitable for receiving radioactive waste products. Of course, when the patient is being treated for contamination by other materials which are not radioactive, the same container can be employed to receive the fluids which are to be collected and disposed of properly.

The backboard 15 is normally of a standard size which fits most patients and is of a predetermined rigid construction to support persons up to 300 lbs in weight. Typically, the backboard will be about 6 feet in length and about 18 inches in width. Backboards, which are constructed from a high strength durable fiberglass material, may be in the order of one inch in thickness.

Figure 2:
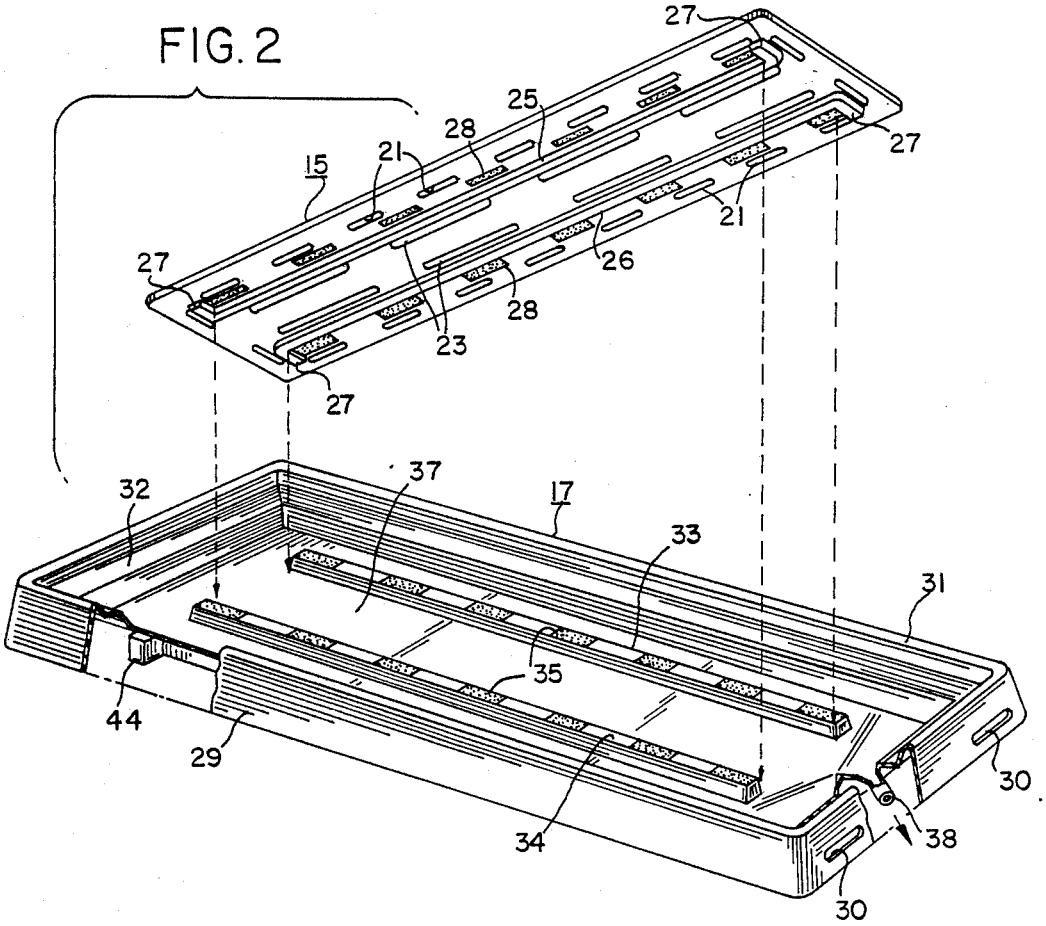
FIG. 2 is an exploded perspective view of the decontamination table of this invention, having certain portions broken away and in section to show more clearly certain details of construction.
Figure 4:
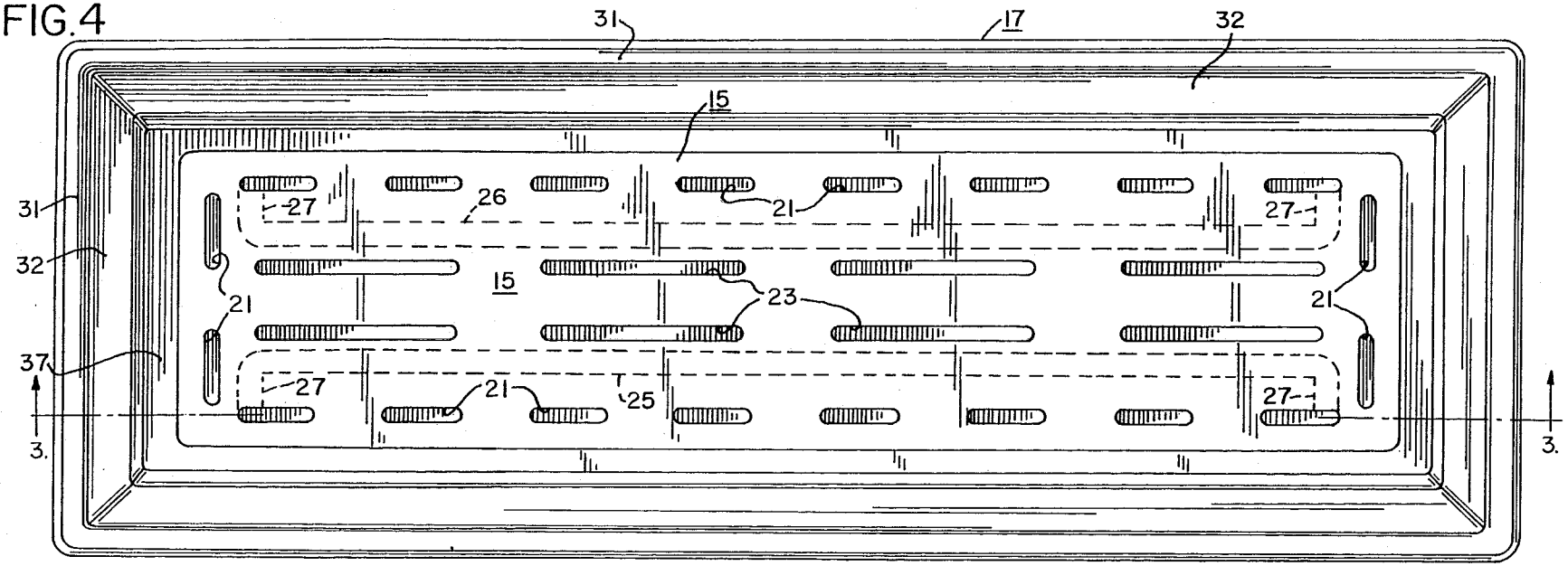
FIG. 4 is a plan view of the decontamination table shown in FIGS. 1, 2, and 3.
Figure 6:
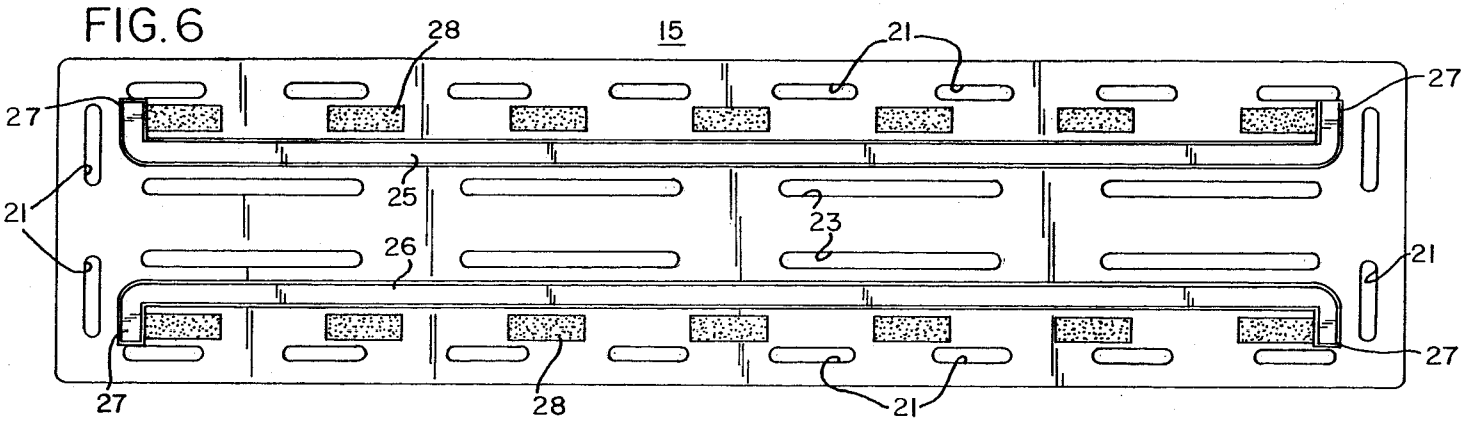
FIG. 6 is a bottom plan view of the backboard, taken along the line 6—6 of FIG. 3.

Directly molded into the backboard are a plurality of slots which are arranged in a prearranged pattern. As shown in FIGS. 2, 4 and 6, the periphery of the backboard 15 contains a plurality of smaller slots 21 which are arranged longitudinally along the length and laterally along the width of the backboard 15 so as to provide convenient hand grips so that the backboard may be lifted and held securely by as many attendants and at as many locations as are necessary to safely transport the patient on the backboard. Also, contained in the interior portion of the backboard 15 are longer open slots 23 which are arranged longitudinally and which permit larger quantities of fluid to flow from the patient being treated.

As is shown in FIGS. 2 and 6, the underside of the backboard includes a plurality of ribs extending a predetermined distance from that underside so as to provide space between the underside of the backboard and the surface upon which it rests. Specifically, a pair of longitudinally extending ribs 25 and 26 extend substantially along the underside of the backboard 15 and are located in a position which permits the relatively rigid backboard to fully support a patient while providing a space underneath the backboard to permit fluid to flow. Longer open slots 23 are positioned inside the ribs 25 and 26. Positioned on the terminal ends of the longitudinal ribs 25 and 26 are truncated heel portions 27 which extend the ribs in a direction perpendicular to the length of the ribs. These laterally directed heels 27 provide additional stability and as will be shown below, assist in the positioning of the backboard 15 on the table 17.

Table 17, as shown in FIG. 2, is constructed from a high strength, resistant material which has no exposed metal parts and which is easily cleanable. For a 6 foot backboard, a table having a length of 7.25 feet and a width of 2 feet 7 inches provides sufficient space for the backboard as described above.

The table 17 contains an outer side wall 29 which is provided with handholds 30 at each end of the table 17. Typically, the overall height of the table will be about 7 inches. Optionally, handholds could be provided on the longitudinal sides of the table. However, the patient is moved by lifting the backboard and it is unlikely that the entire table and backboard would be lifted from the gurney while a patient was lying on the backboard.

The side wall 29 has a raised lip portion or rim 31 which extends around the periphery of the table. A ledge portion 32 extends inward from the lip 31 to provide an enlarged patient support area. A gap of at least one inch between ledge 32 and the periphery of board 15 allows for drainage spacing. While the backboard 15 is certainly adequate in size for transporting patients, as is clear from FIG. 1, the ledge 32 increases the patient support area and permits a greater degree of freedom to move the limbs of the patient to achieve a more thorough decontamination or treatment for the patient. The gap between ledge 32 and backboard 15 does not interfere with this additional support area.

The backboard 15 is located in the table 17 by a pair of rails 33 and 34 which cooperate with the ribs 25 and 26, and heels 27. When the backboard 15 is placed on the basin 37 of the table 17, the ribs 25 and 26 fit directly inside rails 33 and 34 to fixedly place the backboard 15. The ribs 25 and 26 and the rails 33 and 34 prevent lateral movement between the backboard and the basin 37. Similarly, the heels 27 on ribs 25 and 26 cooperate with the rails 33 and 34 to prevent longitudinal movement between the backboard 15 and the basin 37. In an alternative embodiment, of course, the rails 33 and 34 could be provided with terminal transverse truncated heel portions like heels 27 so as to engage the ribs 25 and 26. The preferred embodiment, illustrated in FIG. 2, permits the heels 27 to provide additional support for the backboard 15 when it is placed on other surfaces during, for example, the time when the patient is being removed from the accident site.

Another preferred embodiment which provides further stability for the patient during treatment, when the backboard 15 is positioned on the basin 37, is the use of pressure sensitive stripping sold under the trade name Mushroom Locks to provide an easy release fastening mechanism to hold the backboard 15 in place. Other similar materials such as velcro can be used.

Figure 3:
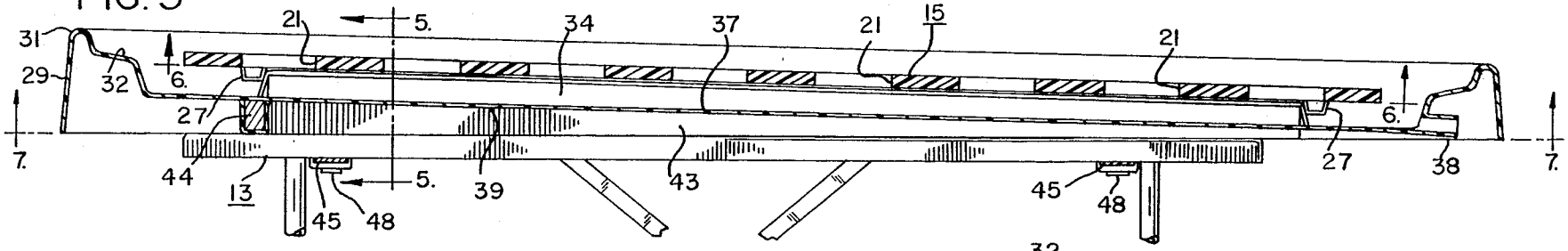
FIG. 3 is a sectional side elevational view of the decontamination table shown in FIGS. 1 and 2, taken along a section line 3—3 shown in FIG. 4.
Figure 5:
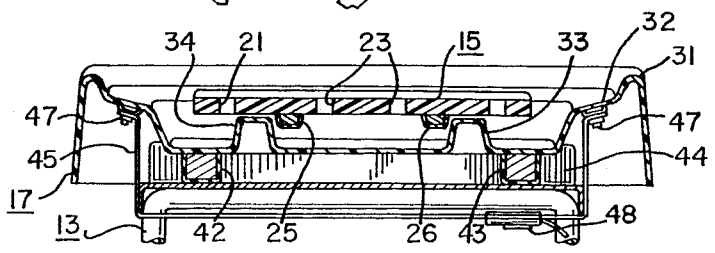
FIGS. 5 is a transverse sectional elevational view taken along the line 5—5 of FIG. 3, showing additional details of construction.
Figure 7:
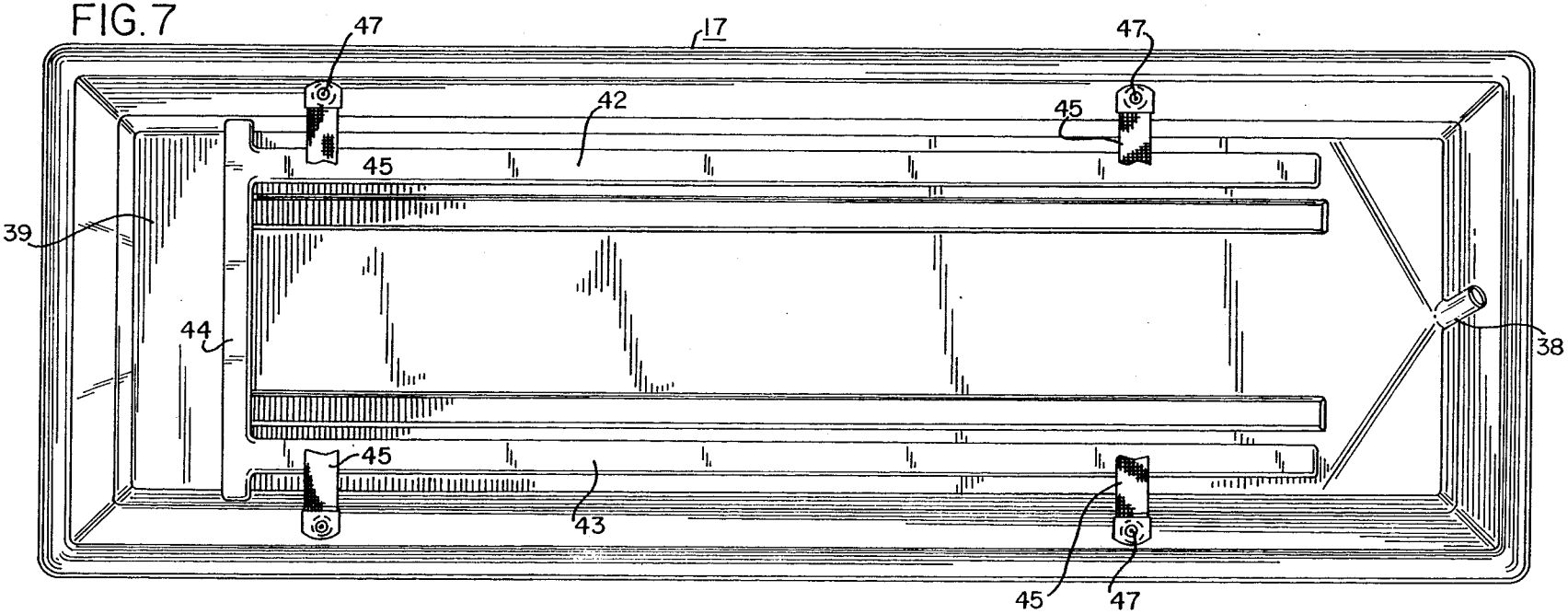
FIG. 7 is a bottom plan view of the decontamination table taken along the line 7—7 of FIG. 3.

In FIG. 7, the bottom 39 of the table 17 is shown as it is positioned for mounting on gurney 13. A side view is also shown in FIG. 3. The bottom portion 39 of the table 17 includes a plurality of runners 42 and 43 which extend longitudinally for sufficient distance along the length of the table 17 to provide a stabilizing base for the table and to provide a surface for attachment to the gurney 13. Runners 42 and 43 rest on the gurney 13 and are secured by straps 45 which are mounted to the table 17 by mounting bolts 47. Straps 45 are mounted on the underside of table 17 and are thus out of the way from inadvertent contamination during the use of the table. As shown in FIG. 5, the straps 45 are bolted to the underside of table 17 and are secured to gurney 13 by a belt lock 48. Typically, conventional automobile seatbelts may be used so that the buckle 48 has a quick release feature as provided in ordinary automobile seatbelts.

Also shown in FIG. 2 and other views is the spout 38 which is connected to the accordion pleated hose 18 and the container 19. In order to facilitate passage of fluid from basin 37 through spout 38, it is preferred to incline the basin 37 with respect to the horizontal plane. In FIGS. 3 and 7, a cross-member 44 which forms a transverse heel at the ends of runners 42 and 43 insures the elevation of the head end of basin 37 and aids in preventing, rocking motion, especially on padded surfaces as it rests on the gurney 15. The runners 42 and 43 are tapered from the head end 44 to the end near spout 38 to provide a slight angle with respect to the horizontal plane. Thus fluid which is washed off of the patient will flow to the spout 38 and through accordion pleated hose 18 into container 19.

As can be readily appreciated, the decontamination table of this invention is admirably suited for removal of toxic chemicals, radioactive materials or biological agents or organisms from non-ambulatory patients. The patient, when placed upon the backboard 15 can be lifted into the table 17. The table 17 may be locked in place on gurney 13 via locking straps 45 and belt lock 48. Attachment of the accordion pleated hose 18 to a waste water container with handles and a sealed lid will permit collection of wash fluids for convenient disposal. The ledge 32 permits the patient to be treated on an enlarged patient support area. The bonding material 28 and 35 along with ribs 25 and 26 in cooperation with rails 33 and 34 and heels 27 prevent movement in either the longitudinal or the lateral direction so that the backboard is securely positioned within the basin 37. After treatment and decontamination, the patient can be removed by lifting the backboard 15 or by transfer of the decontaminated patient to another gurney or stretcher. The entire device may be cleaned since it is manufactured from fiberglass or other resistant easily cleanable materials. One particular advantage of using fiberglass construction is that it is resistant to most solutions and chemicals. Another advantage is that it is radio-translucent and therefore xrays may be taken through the device. It is also light in weight and is easily stored. In another embodiment, runners 42 and 43, rails 33 and 34 or ribs 25 and 26 can be segmented to decrease the weight of the device without loss of structural strength or support.

While particular embodiments of the present invention have been illustrated and described herein, it is not intended to limit the invention and changes and modifications may be made therein within the scope of the following claims.

What is claimed is:

1. A decontamination table device for use with a gurney, comprising a backboard and a table having a base:

said backboard having a predetermined shape and size to provide a patient support area, said backboard including a plurality of spaced apart slots through the thickness thereof to permit fluid flow from said patient to the underside of said backboard, a plurality of ribs projecting a predetermined distance from said underside to provide a clearance between the backboard and base of said table; and said table including a basin sized to receive said backboard, said basin including a drain for removal of fluids, said table further having a raised lip portion around the periphery of said table and a ledge portion spaced inwardly from said lip to provide an enlarged patient support area, said basin having a plurality of rails facing the underside of said backboard and cooperatively associated with said ribs to support said backboard against movement in said basin, said table further including a plurality of runners on the underside of said table positioned to support said table on a gurney, and locking means for attaching said table to said gurney.

2. The device of claim 1, wherein said ribs on the underside of said backboard comprise a pair of longitudinally extending ribs and the rails on said basin comprise a pair of longitudinal rails, whereby said ribs and said rails are positioned to prevent lateral movement between said backboard and said basin.

3. The device of claim 1, wherein said pair of longitudinal ribs further includes terminal transverse truncated heel portions positioned to prevent longitudinal movement between said backboard and said basin.

4. The device of claim 1, wherein said basin is inclined with respect to a horizontal plane to provide drainage to said drain.

5. The device of claim 4, wherein said plurality of runners on the underside of said table are tapered to provide said angled basin.

6. The device of claim 5, wherein said runners on the underside of said table include a pair of longitudinally extending tapered runners having a terminal transverse member at the elevated end of said basin.

7. The device of claim 1, which further includes pressure sensitive fastening means for attaching said backboard to said basin.

8. The device of claim 1, wherein said backboard and said table are formed from a radio-translucent material such as high strength fiberglass.

9. The device of claim 1, wherein said locking means includes a plurality of locking strap and belt locks for strapping the underside of the table to said gurney.

10. The device of claim 9, which further includes pressure sensitive fastening means for attaching said backboard to said basin.

11. The device of claim 9, wherein said pair of longitudinal ribs on the underside of said backboard further includes terminal transverse truncated heel portions positioned to prevent longitudinal movement between said backboard and said basin.

12. A decontamination table device for use with a gurney, comprising:

a backboard having a generally rectangular shape and size to provide a patient support area, said backboard including a plurality of spaced apart slots through the thickness thereof to permit fluid flow from said patient to the underside of said backboard, said underside including a pair of longitudinally extending ribs extending a predetermined distance from said underside; and a table having a generally rectangular shape and including a slanted basin sized to receive said backboard, said basin being slanted at an angle with respect to the horizontal plane to direct fluid to a drain for removal of fluids, said table further having a raised lip portion around the periphery of said table and a ledge portion extending inward from said lip toward said backboard to provide an enlarged patient support area while maintaining a gap between said ledge and said backboard, said basin having a pair of longitudinal rails facing the underside of said backboard and located to cooperatively position said backboard, whereby said ribs of said backboard and said rails of said basin are positioned to prevent lateral movement between said backboard and said basin, said table further having a pair of longitudinally extending runners on the underside of said table positioned to support said table on a gurney and inclined at an angle with respect to the horizontal plane, said table further including locking means comprising a plurality of locking straps and belt locks on the underside of said table for attaching said table to said gurney.

* * * * *